US009115428B2

(12) United States Patent
Hoehn et al.

(10) Patent No.: US 9,115,428 B2
(45) Date of Patent: Aug. 25, 2015

(54) METHOD FOR ENHANCING CORROSION RESISTANCE OF A METALLIC COATING ON A STEEL STRIP OR PLATE

(75) Inventors: Winfried Hoehn, Neuwied (DE); Helmut Oberhoffer, St. Johann (DE); Benjamin Johannes Liebscher, Welschneudorf (DE); Reiner Sauer, Neuwied (DE)

(73) Assignee: Thyssenkrupp Rasselstein GmbH, Andernach (DE)

( * ) Notice: Subject to any disclaimer, the term of this patent is extended or adjusted under 35 U.S.C. 154(b) by 0 days.

(21) Appl. No.: 14/001,939

(22) PCT Filed: Jan. 2, 2012

(86) PCT No.: PCT/EP2012/050012

§ 371 (c)(1),
(2), (4) Date: Oct. 21, 2013

(87) PCT Pub. No.: WO2012/116847

PCT Pub. Date: Sep. 7, 2012

(65) Prior Publication Data

US 2014/0162087 A1 Jun. 12, 2014

(51) Int. Cl.
*C23C 2/28* (2006.01)
*B05D 3/06* (2006.01)
(Continued)

(52) U.S. Cl.
CPC . *C23C 26/00* (2013.01); *B05D 3/06* (2013.01); *C23C 2/08* (2013.01); *C23C 2/28* (2013.01);
(Continued)

(58) Field of Classification Search
CPC ..... C23C 2/28; C23C 2/285; B05D 3/06; C25D 5/505
USPC ..... 427/551, 552, 553, 554, 555, 556, 557, 427/559
See application file for complete search history.

(56) References Cited

U.S. PATENT DOCUMENTS 4,212,900 A * 7/1980 Serlin ..... 148/241
4,335,362 A * 6/1982 Salathe et al. ..... 372/43.01
(Continued)

OTHER PUBLICATIONS

English Translation of Written Opinion (WO) published Sep. 1, 2013 for International Patent Application No. PCT/EP2012/050012 filed Jan. 2, 2012.
(Continued)

*Primary Examiner* — Dah-Wei D Yuan
*Assistant Examiner* — Nga Leung V Law
(74) *Attorney, Agent, or Firm* — Fleit Gibbons Gutman Bongini & Bianco PL; Martin Fleit; Paul D. Bianco

(57) ABSTRACT

The invention relates to a method for enhancing a metallic coating on a steel strip or steel plate, the coating being melted by heating to a temperature above the melting temperature of the material of the coating, the heating taking place by irradiation of the surface of the coating with electromagnetic radiation having a high power density over a limited irradiation time of not more than 10 μs, and the mandated irradiation time and the energy density introduced into the coating by the electromagnetic radiation being selected such that the coating melts completely over its entire thickness down to the boundary layer with the steel strip, thereby forming a thin alloy layer at the boundary layer between the coating and the steel strip. The invention further relates to a steel strip or steel plate having a metallic coating, more particularly a coating of tin, zinc or nickel, in which, at the boundary layer between the steel and the coating, an alloy layer which is thin—compared with the thickness of the coating—and at the same time is dense, and is composed of iron atoms and atoms of the coating material, is formed, the thickness of the alloy layer corresponding to an alloy-layer add-on of less than 0.3 g/m$^2$.

19 Claims, 11 Drawing Sheets

(51) Int. Cl.

| | |
|---|---|
| ***C23C 26/00*** | (2006.01) |
| ***C23C 2/08*** | (2006.01) |
| ***C25D 5/50*** | (2006.01) |

(52) U.S. Cl.

CPC ..... *C23C 2/285* (2013.01); *C25D 5/505* (2013.01); *Y10T 428/12722* (2015.01); *Y10T 428/12799* (2015.01); *Y10T 428/12937* (2015.01)

(56) References Cited

U.S. PATENT DOCUMENTS

| | | | | |
|---|---|---|---|---|
| 4,400,408 | A * | 8/1983 | Asano et al. | 419/8 |
| 4,964,967 | A | 10/1990 | Hashimoto et al. | |
| 6,103,395 | A | 8/2000 | Andler et al. | |
| 6,673,470 | B2 | 1/2004 | Shigekuni et al. | |
| 6,744,005 | B1 | 6/2004 | Beyer et al. | |
| 2003/0129442 | A1 | 7/2003 | Shigekuni et al. | |

OTHER PUBLICATIONS

English Translation of International Preliminary Report on Patentability (IPRP) published Sep. 3. 2013 for International Patent Application No. PCT/EP2012/050012 filed Jan. 2, 2012.

* cited by examiner

METHOD FOR ENHANCING CORROSION RESISTANCE OF A METALLIC COATING ON A STEEL STRIP OR PLATE

FIELD OF THE INVENTION

The invention concerns a method for enhancing a metallic coating on a steel strip or steel plate.

BACKGROUND OF THE INVENTION

In the production of galvanically coated steel strips, for example, in the production of tin plate, a method is known for increasing the corrosion resistance of the coating by a melting of the coating according to the galvanic coating process. To this end, the coating deposited galvanically on the steel strip is heated to a temperature above the melting point of the coating material and subsequently quenched in a water bath. By the melting of the coating, the surface of the coating receives a shiny appearance and the porosity of the coating is reduced, wherein its corrosion resistance increases and its permeability for aggressive substances, for example, organic acids, is reduced.

The melting of the coating can, for example, take place by means of inductive heating of the coated steel strip or by electric resistance heating. From DE 1 277 896, for example, a method for increasing the corrosion protection of metallized iron strips or plates is known, in which the metallic coating is melted by an increase to a temperature above the melting temperature of the coating material and is exposed to high-frequency oscillations during the crystallization process, in the range between the melting temperature and the recrystallization temperature. From DE 1 186 158-A, an arrangement for the inductive heating of metallic strips for the melting of, in particular, electrolytically applied coatings on steel strips is known.

With the known methods for the melting of metallic coatings on steel strips or plates, the entire steel strip or plate, including the applied coating, is as a rule heated to temperatures above the melting temperature of the coating material and subsequently again cooled to a normal temperature, for example, in a water bath. For this, a considerable consumption of energy is required.

SUMMARY OF THE INVENTION

Proceeding from this, the goal of the invention is to indicate a method for enhancing a metallic coating on a steel strip or plate, which in comparison to the known methods is substantially more energy-efficient. The method should also attain a high corrosion stability of the coating treated in accordance with the method, even in the case of thin coating layers.

These goals are attained with the method described herein. Preferred embodiments of the method in accordance with the invention are also described herein.

With the method in accordance with the invention, the metallic coating is melted, at least on its surface and over a partial area of its thickness, by heating to a temperature above the melting temperature of the coating material, wherein the heating takes place by an irradiation of the surface of the coating with high-power-density electromagnetic radiation over a limited irradiation time of at most 10 μs. The energy requirement is independent of the thickness of the plate. It has become surprisingly evident that in comparison to a medium standard thickness with tin plate of 0.2 mm, for example, in the case of melting on both sides, within an irradiation time of at most 10 μs, approximately 90% less heat energy is needed in the strip. For the total energy requirement, the degree of absorption—dependent on the wavelength of the irradiation, surface characteristics of the coating, and so forth—and the efficiency of the irradiation source have to be taken into consideration.

The limited irradiation time can thereby be attained by the use of a pulsed irradiation source, which emits the electromagnetic radiation in short pulses with a maximum pulse duration of 10 μs. The irradiation time can also be limited to the maximum value of 10 μs in that an irradiation source emitting electromagnetic irradiation continuously is used, which in comparison to the coated steel strip, is moved at a high speed. This embodiment of the invention is offered, in particular, in strip coating units in which a coated steel strip passes through a coating unit in the strip length direction at a high speed. In the production of tin plate in a strip tinning unit, strip speeds of up to 700 m/min are attained, for example, in the electrolytic tinning of a steel strip. With such high strip moving speeds, it is possible to keep irradiation times of at most 10 μs, to be maintained in accordance with the invention, by focusing the electromagnetic radiation on the surface of the coating, without requiring a pulsed irradiation of the electromagnetic radiation.

Appropriately, the irradiation of the coated surface of the steel strip or plate takes place with a high-power-density laser beam. From the state of the art, short-pulse lasers are known, which emit high-power laser beams with pulse durations in the range of nanoseconds (ns). With such short-pulse lasers, the irradiation time in the method in accordance with the invention can also be reduced to values below 100 ns. The attaining of these irradiation times is also conceivable with a cw laser.

On the basis of the low irradiation time, the electromagnetic radiation emitted onto the surface of the coating merely heats the surface and a partial area or the entire thickness of the coating to temperatures above the melting temperature of the coating material. The steel strip or plate underneath is, however, only insubstantially heated. An appreciable energy input by the irradiation of the coated surface occurs with the method in accordance with the invention, in any case, into the uppermost layers of the surface of the steel. In this way, after the short-term melting of the coating, it is possible to remove the heat introduced into the coating by the still cool steel strip or plate. The temperature compensation after the melting of the coating thus takes place automatically in the method of the invention by the removal of the heat in the coating through the still cool steel band or plate. A subsequent quenching in a water bath, as with the known methods, is no longer required. In this way, considerable energy can be saved, which, with the known methods, must be used by the heating of the entire steel strip or plate to temperatures above the melting temperature of the coating material and the subsequent quenching in the water bath.

In a preferred embodiment of the method in accordance with the invention, an irradiation source, which emits an electromagnetic radiation, is moved, for the heating of the coating, in the transverse direction of a steel strip moving at the speed of the strip. Appropriately, it is also possible to use several irradiation sources for the irradiation of the surface of the coating; their irradiation is guided onto the surface of the coating in such a way that the entire surface of the coating is irradiated. Appropriately, the rays of the individual irradiation sources are conducted next to one another and overlapping in partial areas on the surface of the coating. The various irradiation sources can also thereby be moved relative to the coated steel strip, which continues to move itself at a prespecified strip moving speed in the direction of the length of the strip.

The electromagnetic irradiation emitted by the irradiation source or the irradiation sources is thereby focused by means of a deflection and focusing device onto the surface of the coating. Appropriately, the diameter or the expansion of the or of each focus is adapted to the speed of the moving steel strip (speed of the strip) in such a way that a prespecified point on the surface of the coating goes through the expansion of the focus in the strip moving direction within the prespecified irradiation time of a maximum 10 μs. This can guarantee that each point on the surface of the coating is irradiated with the electromagnetic radiation no longer than the maximum irradiation time.

The irradiation source or the irradiation sources are appropriately arranged in such a way that the entire surface of the coating is irradiated as uniformly as possible and at most over an irradiation time that is less than the maximum irradiation time of 10 μs. An area of more than 1 $m^2$ per second is preferably treated with the electromagnetic radiation by irradiation of the coating surface.

Preferably, the energy density that is introduced into the coating by the electromagnetic radiation and the prespecified irradiation time are selected and coordinated to one another in such a way that the coating melts completely over its entire thickness to the boundary layer with the steel strip. In this way, a part of the introduced heat is also conducted into the steel strip, wherein energy or heat losses arise. However, in conducting the method in this preferred manner, an alloy layer, which is thin (in comparison with the thickness of the coating), is surprisingly formed on the boundary layer between the coating and the steel strip; it consists of iron atoms and atoms of the coating material. The energy density is preferably selected in such a way that only a part of the coating alloys with the steel strip or the steel plate and therefore, unalloyed coating is still present after the melting. Therefore, with tinned steel bands, for example, a very thin iron-tin alloy layer forms on the boundary layer between the tin coating and the steel. The thickness of the alloy layer thereby corresponds—depending on the selected process parameters—approximately to a weight per unit area of only 0.05 to 0.3 $g/m^2$. This ensures that also with thin total tin layers of, for example, 2.0 $g/m^2$, a very good corrosion-resistant alloy layer is attained with an optically attractive surface. This very thin alloy layer leads to an increased corrosion resistance of the coated steel and to an improved adhesion of the coating on the steel strip or plate.

BRIEF DESCRIPTION OF THE DRAWINGS

The invention is explained in more detail below with the aid of various embodiment examples, with reference to the appended drawings. The drawings show the following;

FIG. 7*b:* 700° C. surface temperature, and FIG. 7*c:* 1000° C. surface temperature);

DETAILED DESCRIPTION OF THE INVENTION

The embodiment examples concern the enhancing of a tinned steel plate or a steel strip coated in a strip tinning unit by the galvanic deposition of a tin layer. The method in accordance with the invention, however, cannot only be used for the enhancement of tinned steel strips, but, very generally, for the enhancement of metallic coatings on steel strips or steel plates. The metallic coatings can also be, for example, coatings made of zinc or nickel.

Figure 1:
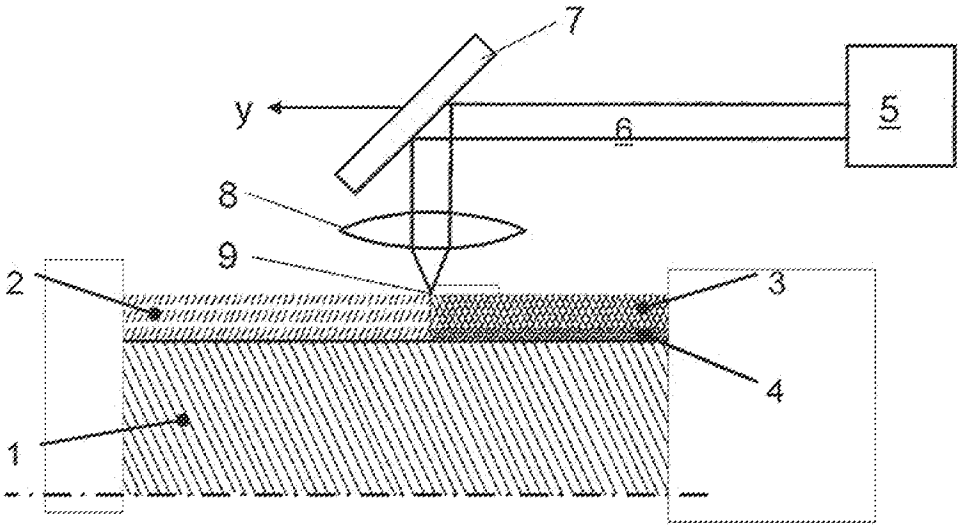
FIG. 1: Schematic representation of a first embodiment of a device for the carrying out of the method in accordance with the invention, wherein a steel plate provided with a metallic coating is shown in cross-section.

FIG. 1 shows schematically a device to carry out the method in accordance with the invention for the enhancing of a metallic coating on a steel plate, wherein here, for example, the enhancing of a tinned steel plate is shown. The steel plate is thereby designated with reference number 1 and the tin coating is marked with reference number 2. The thickness of the tin coating 2, which has been applied, for example, in a galvanic coating method, is typically 0.1 $g/m^2$ to 11 $g/m^2$. For the melting of the coating 2, an irradiation source 5 is provided, which emits an electromagnetic ray 6. The ray 6 is appropriately focused on the surface of the coating 2 by means of a deflection and focusing device. In the embodiment example shown here, the deflection and focusing device comprises a deflection mirror 7 and a focusing lens 8. The focus of the ray 6 on the surface of the coating 2 is marked with the reference number 9 in FIG. 1.

The irradiation source 5 can, for example, be a laser, which emits a high-power-density laser beam. In an embodiment example of the method in accordance with the invention, the laser beam 6 can be a pulsed laser beam. The pulse duration thereby corresponds to the desired irradiation time, which is in accordance with the invention at most 10 μs and is preferably less than 100 ns. In order to melt the coating 2 at least on its surface and over a part of its thickness, the irradiation of a sufficient quantity of heat is necessary, which heats the coating to temperatures above the melting temperature of the coating material within the very short irradiation time of at most 10 μs in accordance with the invention. In the tin coating 2 shown here by way of example, the melting point is 232° C. The electromagnetic radiation emitted by the irradiation source 5 (pulsed laser) appropriately has for this purpose performance densities in the range of $1\times10^6$ to $2\times10^8$ $W/cm^2$, and the energy density irradiated onto the surface of the coating by the electromagnetic radiation within the irradiation time ($t_A$) is in the range of 0.01 J/cm$^2$ to 5.0 J/cm$^2$.

In order to be able to irradiate the entire surface of the coating 2 with a pulsed laser beam 6, the irradiation source 5 (laser) or the laser beam 6 is movable with reference to the steel plate 1 provided with the coating 2. For this purpose, for example, in the embodiment example shown in FIG. 1, the deflection and focusing device consisting of the deflection mirror 7 and the focusing lens 8 can be moved in the transverse direction with respect to the steel plate 1. For the full-surface irradiation of the coated steel plate, the deflection and focusing device is moved step by step in the transverse direction y relative to the steel plate 1 so that the focus 9 migrates over the surface of the coating 2.

By means of the irradiation of the high-energy laser radiation 6, the coating 2 is heated short-term, within the prespecified irradiation time, on its surface and—depending on the selected performance of the laser beam 6—over a part of or over its entire thickness to temperatures above the melting temperature. In this way, the coating 2 is partially or completely melted. By the melting, the surface of the coating 2 receives a shiny appearance and the structure of the coating 2 is compacted. In FIG. 1, the surface area of the coating 2, which is melted during the movement of the focus 9 over the surface of the coating 2, is marked with the reference number 3.

If within the short irradiation time such a high energy density is irradiated into the coating 2 that the coating 2 melts over its entire thickness, a very thin alloy layer is formed at the boundary layer of the coating 2 with the steel plate 1. With a tin coating 2, for example, an iron-tin alloy layer is formed, which is marked with reference number 4 in FIG. 1. The thickness of the iron-tin alloy layer is not drawn to scale in the representation of FIG. 4. The thickness of the formed iron-tin alloy layer is as a rule very thin and typically corresponds to an alloy layer with a weight per unit area of 0.05 to 0.3 g/m$^2$.

In order to be able to melt the coating 2, at least on its surface, within the short irradiation time of at most 10 μs, an energy density between 0.01 J/cm$^2$ to 5.0 J/cm$^2$ has to be irradiated onto the surface of the coating. Preferred ranges of the energy density to be irradiated are at 0.03 J/cm$^2$ to 2.5 J/cm$^2$.

Instead of the use of a pulsed laser 5, it is also possible to use irradiation sources that continuously emit electromagnetic radiation 6. Thus, for example, cw lasers can be used, which emit a laser radiation of sufficiently high-power-density. In order to be able to maintain the short irradiation time of a maximum 10 μs, the electromagnetic radiation 6 must then be moved at a high speed in comparison to the coated steel strip 1.

Figure 2:
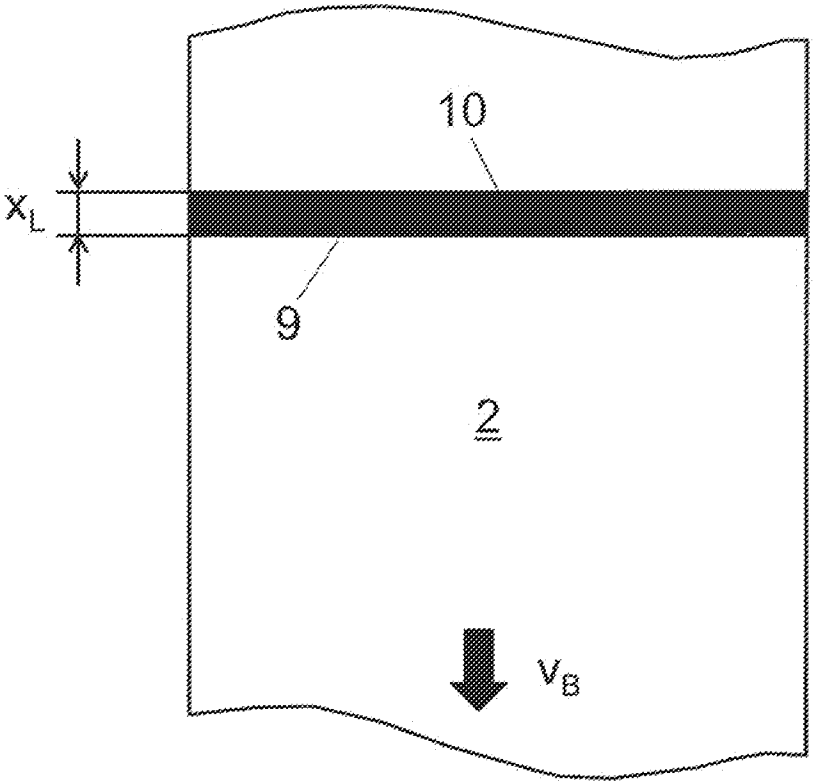
FIG. 2: schematic representation of another arrangement for enhancing the metallic coating on a moving steel strip in a top view of the coated steel strip.

Corresponding embodiment examples, in which the irradiation source 5 or the emitted electromagnetic ray 6 is moved relative to the steel strip 2 are shown schematically in FIGS. 2 to 6. FIG. 2 shows by way of example a steel strip 1, which is moved at a strip moving speed $v_B$ in the direction of the length of the steel strip 1. In strip tinning units, for example, strip speeds of a few hundred meters per minute up to 700 m/min are attained. Typical strip moving speeds are 10 m/s. In the embodiment example of FIG. 2, a laser ray 6 of a cw laser 5 (which is not shown in FIG. 2) is focused on the surface of the coated steel strip 1. The focus can thereby be formed as a line focus 9, which extends in the transverse direction of the steel strip and has an expansion $x_L$ in the direction of the length of the strip. As an alternative to this, several irradiation sources 5 (lasers) can also be used, whose starting radiation 6 is focused as a point focus on the surface of the coated steel strip 1, wherein the optical arrangement for the focusing of the radiation 6 of the various irradiation sources 5 is so arranged that the individual point focuses are next to one another on the surface of the coating and in this way produce a stripe-like irradiation strip 10 on the surface. The line focus 9 or the irradiation strip 10 are [sic; is] thereby firmly arranged and the steel strip 1 is moved relative to the line focus 9 or the irradiation strip 10 in the strip moving direction at the strip speed $v_B$. Expansion of the line focus 9 or the radiation strip 10 in the strip moving direction $x_L$ then takes place, for example, in the prespecified maximum irradiation time of 10 μs and a strip moving speed of 10 m/s, to 0.1 mm.

Figure 3:
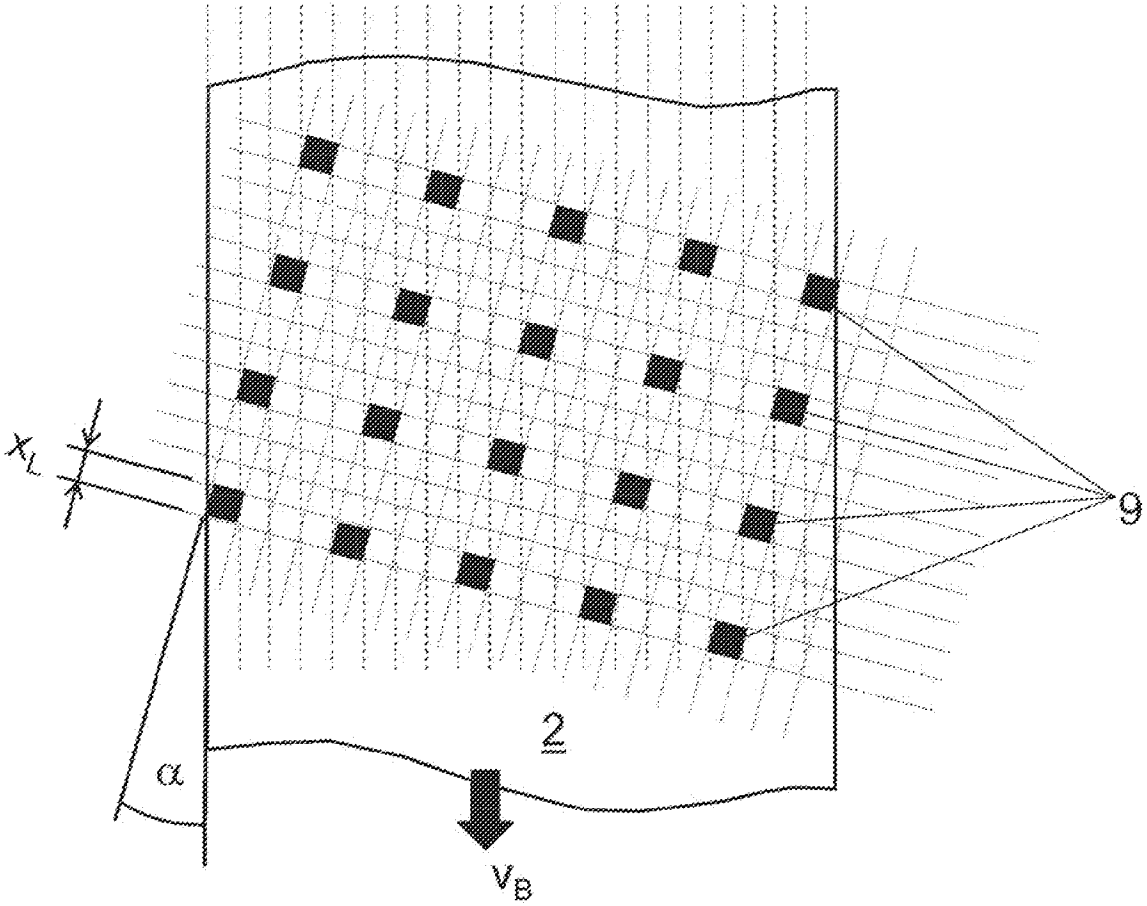
FIG. 3: schematic representation of another arrangement for enhancing the metallic coating on a moving steel strip in a top view of the coated steel strip.

FIG. 3 shows another embodiment of a device for carrying out the method in accordance with the invention. In this embodiment, several irradiation sources 5 (that is, for example, several cw lasers) are used, whose radiation 6 is focused in the form of point focuses 9 on the surface of the coated steel strip 1 moving at a strip moving speed $v_B$. The focuses 9 are thereby arranged in the form of a grid on the surface of the coating 2 as shown schematically in FIG. 3. The expansion of the individual focuses 9 is thereby adapted to the strip moving speed $v_B$ and the prespecified irradiation time $t_A$ of a maximum 10 μs. Appropriately, the "irradiation grid" formed from the focuses 9 and shown in FIG. 3 is tilted by an angle α relative to the longitudinal direction of the steel strip 1 as shown in FIG. 3. The selected expansion $x_L$ of the individual focuses 9 on the surface of the coating is produced with a tilting angle α, for example, of 15°, to 0.0966 mm.

The "irradiation grid" formed from the focuses 9, in particular, its grid intervals and the tilting angle α, is thereby arranged in such a way that the entire surface of the coating 2 of the steel strip 1 moving at the strip moving speed $v_B$ is irradiated with the electromagnetic radiation (laser radiation).

Figure 4:
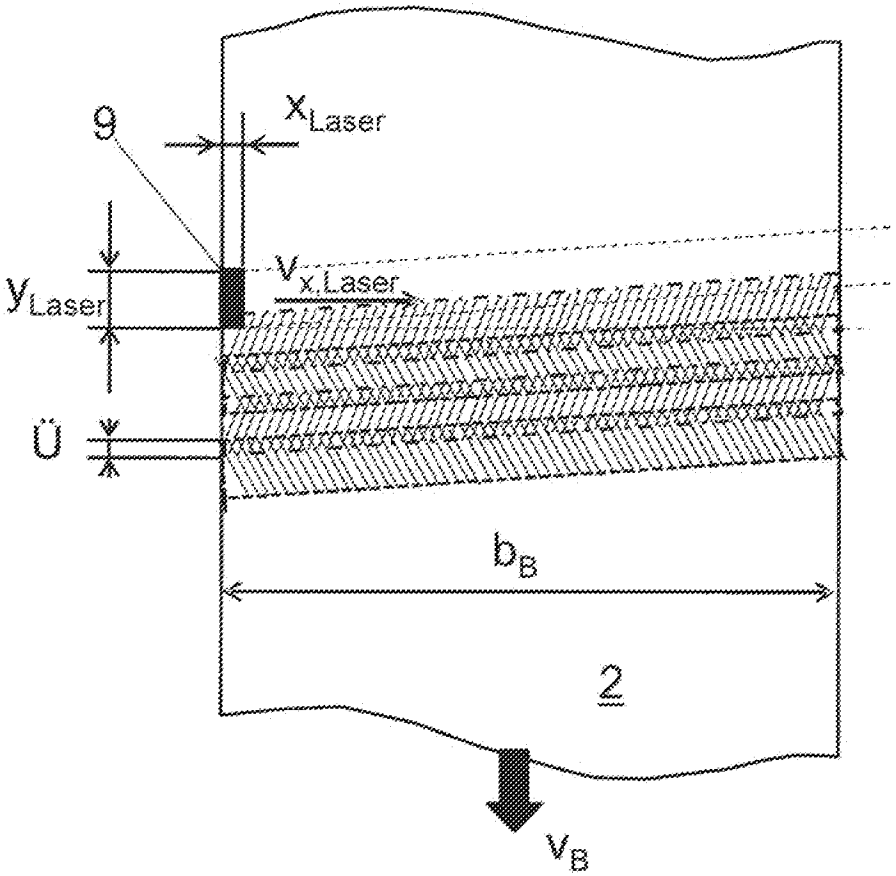
FIG. 4: schematic representation of another arrangement for enhancing the metallic coating on a moving steel strip in a top view of the coated steel strip.

FIG. 4 shows another embodiment of an arrangement for the carrying out of the method in accordance with the invention. With this embodiment, a laser ray 6 of a cw laser 5 is focused on the surface of the coating by means of a focusing device, wherein the focus 9 has an expansion $y_{Laser}$ in the longitudinal direction of the steel strip moving at the strip moving speed $v_\beta$ and an expansion $x_{Laser}$ in the direction transverse to it. The focus 9 is moved in the transverse direction relative to the steel strip 1 over the entire width $b_\beta$ of the steel strip at a speed $v_{x,Laser}$. The selected speed of the focus 9 for the maintenance of the maximum irradiation time of 10 μs relative to the steel strip 1 ($v_{x,Laser}$) is then produced with a, for example, prespecified expansion of the focus of $x_{Laser}$=5 mm, to 500 m/min. [24] [sic] In FIG. 5, Ü designates the overlapping of rays, which are adjacent on the surface.

Figure 5:
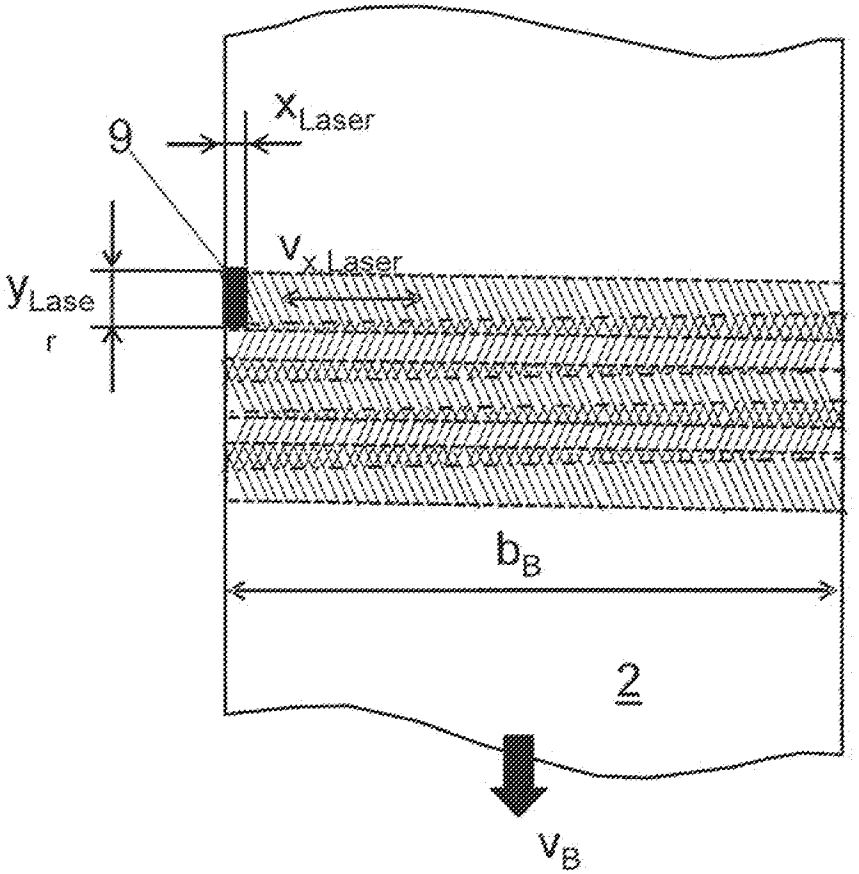
FIG. 5: schematic representation of another arrangement for enhancing the metallic coating on a moving steel strip in a top view of the coated steel strip.
Figure 6:
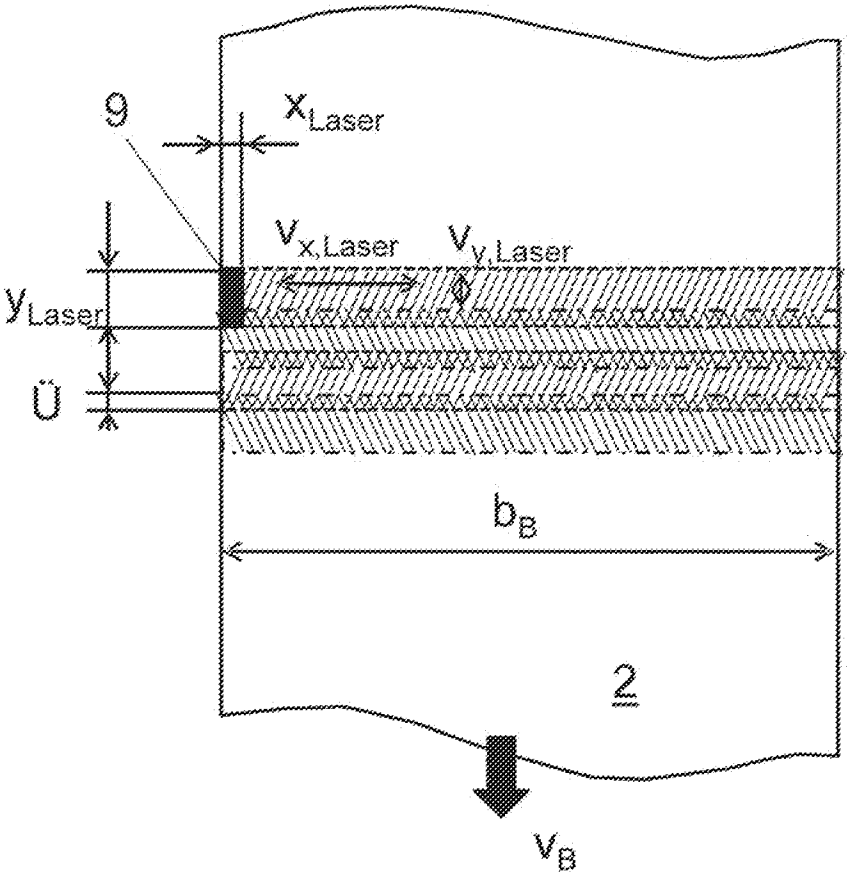
FIG. 6: schematic representation of another arrangement for enhancing the metallic coating on a moving steel strip in a top view of the coated steel strip.

FIGS. 5 and 6 show other embodiments for the carrying out of the method in accordance with the invention, in which a ray is directed as focus 9 onto the surface of a coated steel strip moving at a strip moving speed $v_B$. In the embodiment example of FIG. 5, the focus 9 is thereby conducted via scanner optics inclined to the longitudinal direction of the steel strip at a speed of $v_{x,Laser}$. If the ray focus 9 has reached a strip edge, it is again conducted over the strip to the opposite edge of the steel strip and so forth, whereas the strip is moved further at the strip moving speed $v_B$. The successive ray strips that are produced on the surface overlap thereby, so as to ensure that the entire surface is also reached by the radiation.

In the embodiment example of FIG. 6, the focus 9 is moved in a two axis manner relative to the steel strip—namely, both in the longitudinal direction (x direction) at a speed $v_{x,Laser}$ and also in the transverse direction (y direction) at a speed $v_{y,Laser}$. The speed $v_{y,Laser}$ in the transverse direction (y direction) is thereby appropriately adjusted in such a manner that a uniform overlapping Ü is maintained over the entire width $b_B$ of the steel strip in the y direction.

Figure 9:
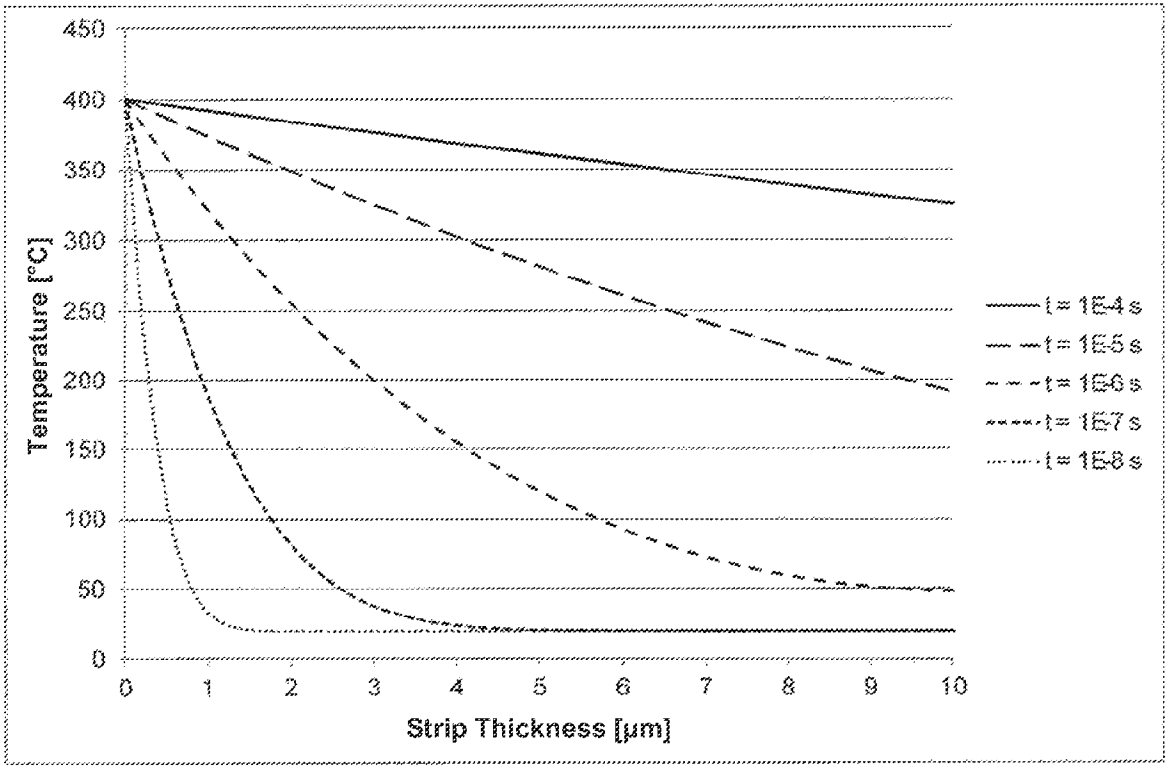
FIG. 9: representation of the temperature profile (T(x)) resulting during the irradiation of a coated steel surface with electromagnetic radiation over the strip thickness (x) or the thickness of the coating for various irradiation times t.

FIG. 9 shows the temperature profile T(x), which is produced during the heating of the coating by the irradiation of the electromagnetic radiation, over the thickness (x) of the coating and the steel strip underneath for various irradiation times t. As can be seen from the temperature profiles of the graph of FIG. 9, a steep temperature profile T(x) is produced for very short irradiation times t in the ns and μs range. With irradiation times of more than 10 μs, there is a flat temperature profile—that is, here, the substantial part of the irradiated energy is deflected into the steel strip. With the very short irradiation times of a maximum 10 μs on the other hand, essentially only the coating, but not the steel strip underneath, is heated.

Figure 7:
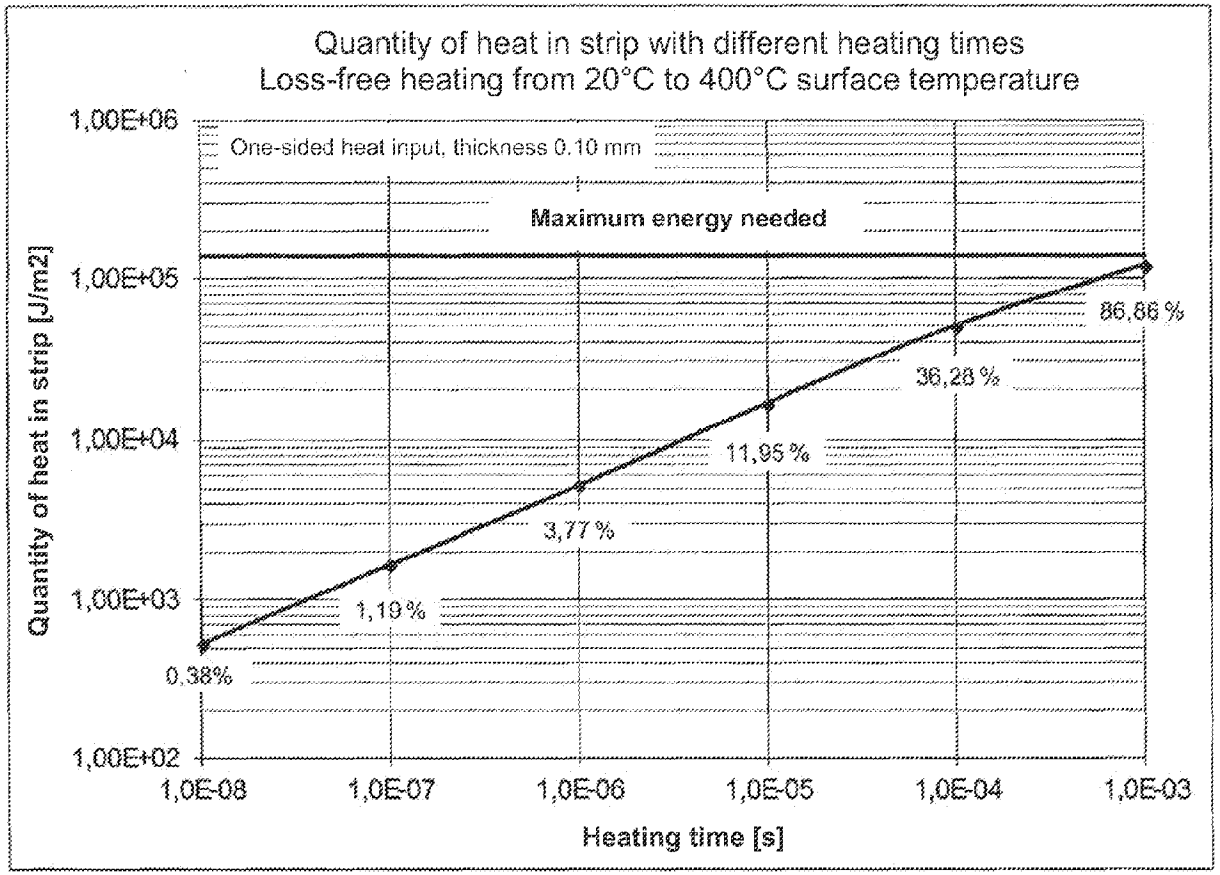
FIG. 7: representation of diagrams developed from model calculations, which shows the heat quantity per unit area introduced into the coated steel strip or plate by irradiation with the electromagnetic irradiation as a function of the irradiation time for various temperatures on the surface of the coating (FIG. 7*a:* 400° C. surface temperature.
Figure 7:
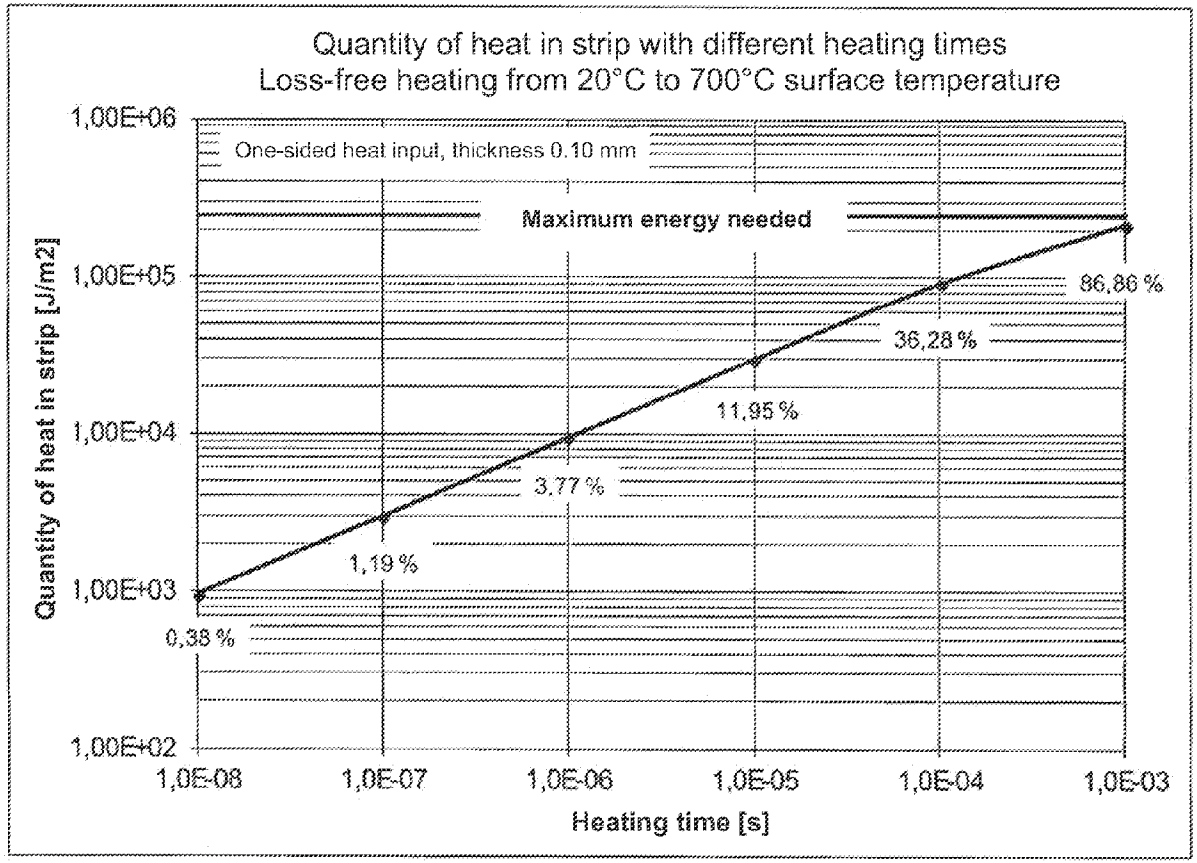
Figure 7:
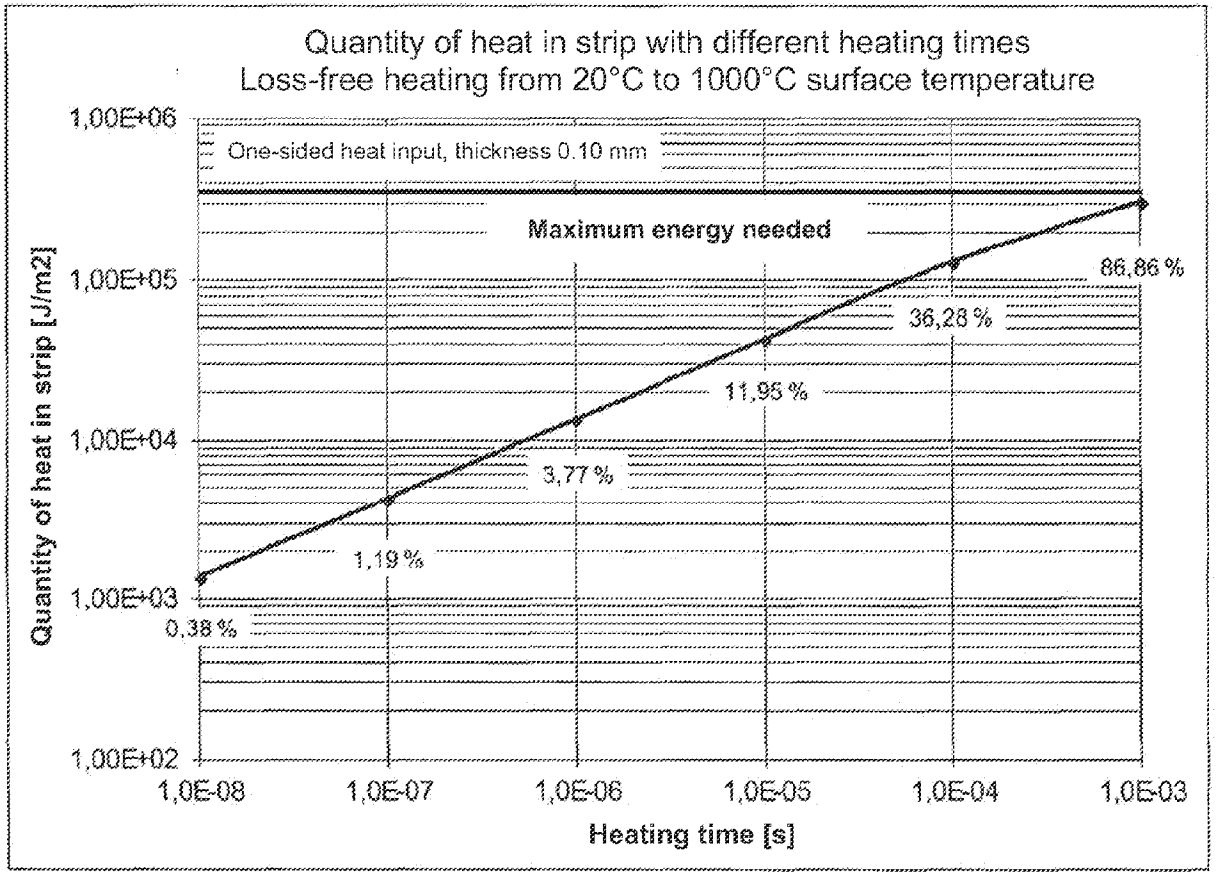

In FIG. 7, the heat quantity per unit area introduced into the coated steel strip is applied as a function of the irradiation time for various surface temperatures. The calculation is carried out free of losses. As a comparison, the "maximum energy density" (maximum energy) is entered. The maximum energy needed is the quantity of energy that is needed for the uniform heating of the complete cross-section.

As can be deduced from the diagrams of FIG. 7, only 12% of the heat can be introduced into the coated steel strip with the irradiation times of at most 10 μs in accordance with the invention in comparison to the maximum energy (maximum energy). In spite of this very small introduction of heat, the coating can be completely melted to the steel strip boundary layer. What is decisive for the melting is merely the (short-term) heating of the coating to temperatures above the melting temperature. By the method in accordance with the invention, therefore, a small quantity of energy of a maximum 12% of the maximum energy can be introduced into the coated steel strip with a maintenance of the prespecified irradiation time of a maximum 10 μs in order to completely melt the coating. The prespecified irradiation time that is a maximum 10 μs in accordance with the invention thereby determines what temperature profile is set up over the thickness x of the coating and the steel strip (FIG. 9). The longer the selected irradiation time for a prespecified surface temperature (which must lie above the melting temperature of the coating), the more heat flows into the depth of the steel strip. This results in, all total, more heat being needed so as to attain a specific temperature on the surface (which, in accordance with the invention, must lie above the melting temperature). If a sufficiently short irradiation time t is selected, it is possible for the substantial part of the irradiated energy to be limited to the area of the coating and for the heat energy not to flow into the steel strip underneath. In this way, one can omit a quenching in the water bath after the melting of the coating has been completed, because the heat in the coating can be conducted away by the (not heated) steel strip.

With the irradiation of a sufficiently high energy density, and depending on the thickness of the metallic coating, it is possible to completely melt the coating—that is, over its entire thickness to the steel surface. With a complete melting of the coating, a very dense alloy layer, which is thin (in comparison to the thickness of the coating) and which consists of atoms of the coating material and iron atoms, is formed. The alloy layer being formed is very thin and corresponds with tin plate to an alloy layer of 0.05 to 0.3 g/m$^2$.

Figure 8:
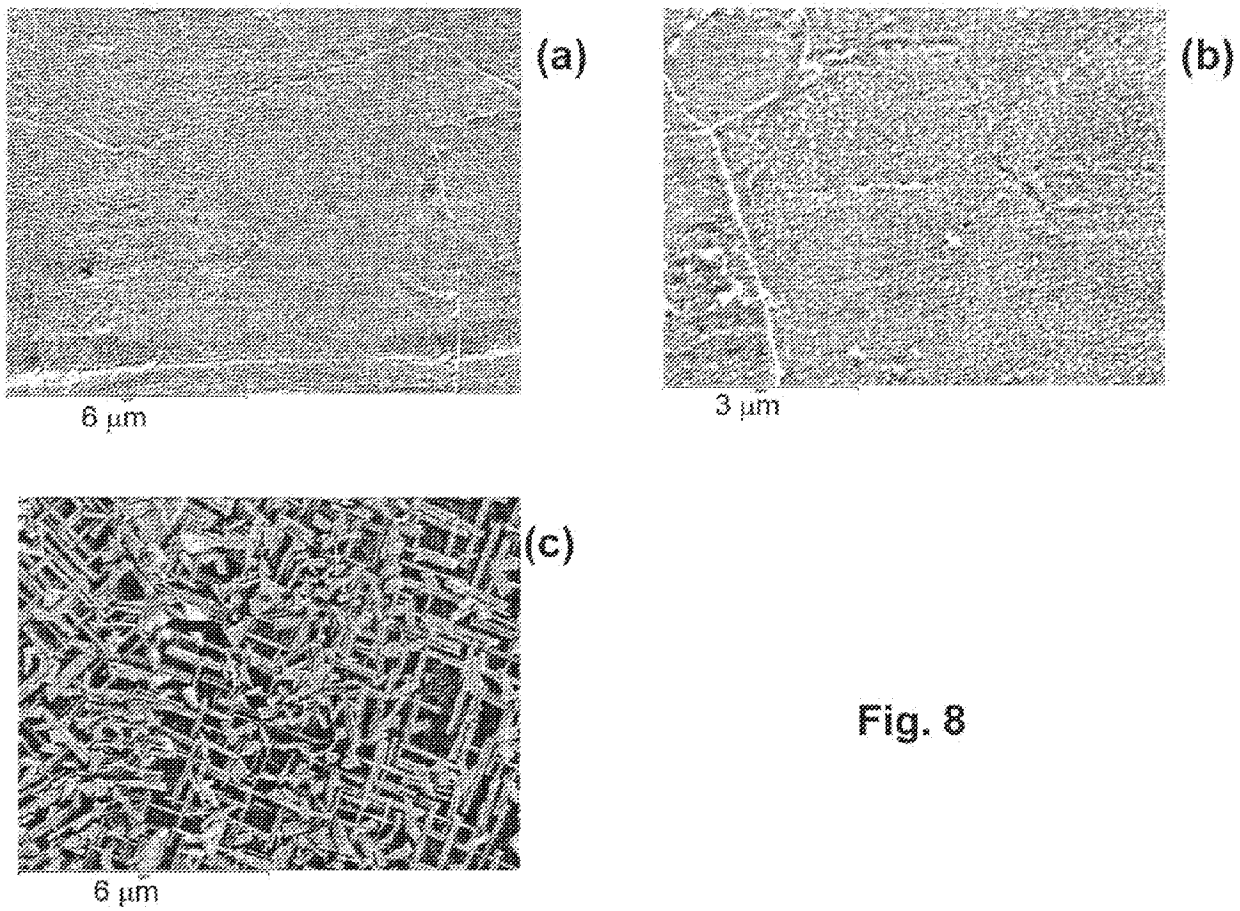
FIG. 8: microprobe photographs of the alloy layers that are formed during the melting of the coating in the area of the boundary layer with the steel surface in the carrying out of the method of the invention (FIGS. 8*a* and 8*b*) and in a traditional method (FIG. 8*c*)

For example, for a tinned steel surface, it can be shown by means of comparison experiments and model calculations that the formation of the alloy layer begins only at temperatures that are clearly higher than the melting point of the coating material, because of the short irradiation times. The alloy layer that is formed with the treatment in accordance with the invention has a basically different microscopic appearance in comparison to the alloy layers formed with the known procedure. This is clear from the microprobe photographs shown in FIG. 8. FIGS. 8*a* and 8*b* show microprobe photographs of alloy layers (after the detaching of the unalloyed tin), which have formed in the area of the boundary layer with the steel surface during the carrying out of the method in accordance with the invention, with the melting of a tin coating on a steel plate. In contrast, FIG. 8*c* shows a microprobe photograph of an iron-tin alloy layer (after the detaching of the unalloyed tin), which has formed during the melting of a tinned steel plate surface, according to the traditional melting process. Comparison experiments, in which the corrosion resistance of correspondingly treated tin plate samples were investigated, have shown that the samples treated according to the treatment process in accordance with the invention have a substantially better corrosion resistance compared with the samples treated according to the conventional process. The corrosion resistance of tin plate, which, for example, can be measured according to the standardized process for the determination of the so-called ATC value (published as ASTN standard 1998 A623N-92, Chapter A5, "Method for alloy-tin couple test for electrolytic tin plate"), increases according to experience with an increasing thickness of the alloy layer. Typical alloy layers are in the range of 0.5 to 0.8 g/m$^2$ with lacquered tin plate; with increased demands for corrosion resistance, in the range 0.8 to 1.2 g/m$^2$ with unlaquered tin plate. For the same corrosion resistance, that is, for the same ATC value, at least a twice as thick alloy layer is needed with the conventional method as with the method in accordance with the invention.

With the method in accordance with the invention, therefore, it is possible to produce steel strips or plates provided with a metallic coating, in which a thin—compared with the thickness of the coating—and simultaneously dense alloy layer, consisting of iron atoms and atoms of the coating material, is formed on the boundary layer of the steel with the coating. The thickness of the alloy layer thereby corresponds to an alloy layer of less than 0.3 g/m$^2$. Thus, for example, tinned steel strips or plates are produced, which, in spite of a comparatively thin tin layer of less than 2.8 g/m$^2$ and, in particular, less than 2.0 g/m$^2$, have a sufficiently good corrosion resistance. Comparison experiments have, for example, shown that with tinned steel plates with a tin layer of approximately 1.4 g/m$^2$ by the treatment in accordance with the invention, an iron-tin alloy layer with an alloy layer of approximately 0.05 g/m$^2$ is formed and that with the tinned steel plate thus treated, it was possible to measure ATC values of less than 0.15 μA/cm$^2$ (according to the ASTN standard).

The invention claimed is:

1. A method for enhancing corrosion resistance of a galvanic tin coating on a tin-coated steel strip or plate, wherein the tin coating is melted by heating to a temperature above a melting temperature of tin, wherein the heating results from irradiation of a surface of the tin coating with electromagnetic radiation having a power density sufficient to melt the tin coating, the electromagnetic radiation limited to a pre-determined irradiation time of at most 10 μs, wherein an energy density introduced by the electromagnetic radiation into the tin coating and the pre-determined irradiation time ($t_A$) are selected so that the tin coating completely melts over its entire thickness to a boundary of the steel strip or plate, and wherein a thin alloy layer is formed at the boundary between the tin coating and the steel strip or plate, the alloy layer composed of tin and iron atoms and having a thickness corresponding to an alloy layer plating of less than 0.3 g/m$^2$.

2. The method according to claim 1, wherein the pre-determined irradiation time is at most 100 ns.

3. The method according to claim 1, wherein irradiation of the surface of the tin coating results from a laser beam having a power density sufficient to heat the tin coating above its melting temperature within the pre-determined irradiation time.

4. The method according to claim 3, wherein the laser beam is pulsed with a maximum pulse duration of 10 μs.

5. The method according to claim 1, wherein the steel strip or plate is moved relative to an irradiation source emitting the electromagnetic radiation.

6. The method according to claim 5, wherein the steel strip or plate is moved in a longitudinal direction of the steel strip or plate at a speed ($V_{strip}$).

7. The method according to claim 6, wherein the irradiation source emitting the electromagnetic radiation is moved in a transverse direction of the steel strip or plate at a source speed ($V_{source}$).

8. The method according to claim 1, wherein irradiation of the surface of the tin coating results from multiple irradiation sources, which emit electromagnetic radiation onto the surface of the steel strip or plate.

9. The method according to claim 8, wherein the electromagnetic radiation is focused on the surface of the tin coating and wherein a diameter of the focus is adapted to speed ($V_{stnp}$) such that a specified point on the surface of the tin coating passes the diameter of the focus within a pre-determined irradiation time ($t_A$).

10. The method according to claim 1, wherein the power density of the electromagnetic radiation emitted from an irradiation source used to heat the surface of the tin coating is between $10^6$ W/cm$^2$ and $2\times10^8$ W/cm$^2$.

11. The method according to claim 1, wherein an energy density of 0.01 J/cm$^2$ to 5.0 J/cm$^2$ is irradiated onto the surface of the tin coating by the electromagnetic radiation within the pre-determined irradiation time ($t_A$).

12. The method according to claim 1, wherein an energy density of 0.03 J/cm$^2$ to 2.5 J/cm$^2$ is irradiated into the tin coating by irradiation of the surface of the tin coating.

13. The method according to claim 1, wherein the thickness of the alloy layer corresponds to an alloy layer plating (weight per unit area) of 0.05 to 0.3 g/m$^2$.

14. The method according to claim 1, wherein the energy density introduced by the electromagnetic radiation into the tin coating and the pre-determined irradiation time are selected so that the tin coating melts completely over its entire thickness to the boundary of the steel strip or plate, and an unalloyed coating area remains in the surface area of the tin coating.

15. The method according to claim 1, wherein an area of the steel strip or plate of more than 1 m$^2$ per second is treated by irradiation with electromagnetic radiation.

16. The method according to claim 1, wherein the tin coating has a tin plating of less than 2.8 g/m$^2$.

17. The method according to claim 6, wherein the speed is up to 700 m/min.

18. The method according to claim 6, wherein the speed is up to 10 m/s.

19. A method for enhancing corrosion resistance of a galvanic tin coating on a tin-coated steel strip or plate, wherein the tin coating is melted by heating to a temperature above a melting temperature of tin, wherein the heating results from irradiation of a surface of the tin coating with electromagnetic radiation having a power density sufficient to melt the tin coating, the electromagnetic radiation limited to a pre-determined irradiation time of at most 10 μs, wherein an energy density introduced by the electromagnetic radiation into the tin coating and the pre-determined irradiation time ($t_A$) are selected so that the tin coating completely melts over its entire thickness to a boundary of the steel strip or plate, wherein a thin alloy layer is formed at the boundary between the tin coating and the steel strip or plate, the alloy layer composed of tin and iron atoms and having a thickness corresponding to an alloy layer plating of less than 0.3 g/m$^2$, and wherein during melting the steel strip or plate is moved at a speed of 10 m/s.

* * * * *